US011052694B2

(12) United States Patent
Kishimoto et al.

(10) Patent No.: US 11,052,694 B2
(45) Date of Patent: Jul. 6, 2021

(54) WATER-DISPERSIBLE SHEET

(71) Applicants: NIPPON PAPER PAPYLIA CO., LTD., Shizuoka (JP); Nippon Paper Industries Co., Ltd., Tokyo (JP)

(72) Inventors: Masaki Kishimoto, Tokyo (JP); Yoshiaki Ishino, Tokyo (JP); Yasuaki Matsumori, Tokyo (JP)

(73) Assignees: NIPPON PAPER PAPYLIA CO., LTD, Shizuoka (JP); Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 16/348,426

(22) PCT Filed: Oct. 23, 2017

(86) PCT No.: PCT/JP2017/038133
§ 371 (c)(1),
(2) Date: May 8, 2019

(87) PCT Pub. No.: WO2018/088179
PCT Pub. Date: May 17, 2018

(65) Prior Publication Data

US 2019/0270328 A1 Sep. 5, 2019

(30) Foreign Application Priority Data

Nov. 9, 2016 (JP) ..... JP2016-218608

(51) Int. Cl.
*D21H 13/06* (2006.01)
*D21H 19/12* (2006.01)
(Continued)

(52) U.S. Cl.
CPC ..... *B41M 5/41* (2013.01); *D21H 13/06* (2013.01); *D21H 19/12* (2013.01); *D21H 27/00* (2013.01); *D21H 27/004* (2013.01)

(58) Field of Classification Search
CPC ..... D21H 19/12; D21H 27/00; D21H 11/00; D21H 13/02; D21H 13/09; D21H 19/80;
(Continued)

(56) References Cited

U.S. PATENT DOCUMENTS 5,849,153 A 12/1998 Ishino et al.
8,673,812 B2 3/2014 Ohse et al.
(Continued)

FOREIGN PATENT DOCUMENTS

EP 0462770 A1 * 12/1991 ..... B41M 5/42
EP 0462770 A1 12/1991
(Continued)

OTHER PUBLICATIONS

European Search Report corresponding to European Patent Application No. 17869300 dated Apr. 29, 2020.
(Continued)

*Primary Examiner* — Jose A Fortuna
(74) *Attorney, Agent, or Firm* — Jenkins, Wilson, Taylor & Hunt, P.A.

(57) ABSTRACT

A water-dispersible sheet is described having suppressed time degradation of the tacky adhesiveness of the tacky adhesive layer, while maintaining water dispersibility. The base paper of the water-dispersible sheet has a multilayer structure, including an inner layer which is not in contact with a tacky adhesive layer and a surface layer which is in contact with the tacky adhesive layer. The layers are independently mixtures of papermaking fibers and an alkalized fibrous carboxymethyl cellulose.

15 Claims, 1 Drawing Sheet

(51) Int. Cl.
*D21H 27/00* (2006.01)
*B41M 5/41* (2006.01)

(58) Field of Classification Search
CPC ..... D21H 27/30; D21H 27/004; B41M 5/41; B41M 2205/32; Y10T 428/2848; B32B 2307/7166
See application file for complete search history.

(56) References Cited

U.S. PATENT DOCUMENTS

| | | | | |
|---|---|---|---|---|
| 8,722,576 | B2 | 5/2014 | Hayakawa et al. | |
| 9,399,841 | B2 * | 7/2016 | Yamada | D21H 27/02 |
| 9,579,916 | B2 | 2/2017 | Matsumori et al. | |
| 2005/0123753 | A1 | 6/2005 | Trochlil et al. | |
| 2006/0216537 | A1 | 9/2006 | Natsui et al. | |
| 2009/0252905 | A1 * | 10/2009 | Hill | B05D 3/0272 428/34.2 |
| 2014/0318726 | A1 | 10/2014 | Collins et al. | |
| 2015/0090414 | A1 * | 4/2015 | Yamada | B31F 1/07 162/109 |
| 2016/0355983 | A1 * | 12/2016 | Yamada | D21H 17/70 |
| 2018/0178570 | A1 | 6/2018 | Matsumori et al. | |
| 2018/0311987 | A1 | 11/2018 | Matsumori et al. | |
| 2019/0270328 | A1 * | 9/2019 | Kishimoto | B41M 5/41 |
| 2020/0040530 | A1 * | 2/2020 | Kishimoto | D21H 11/20 |
| 2020/0095470 | A1 * | 3/2020 | Kishimoto | D21H 27/00 |
| 2020/0231844 | A1 * | 7/2020 | Kishimoto | B41M 5/502 |
| 2020/0308453 | A1 | 10/2020 | Kishimoto et al. | |

FOREIGN PATENT DOCUMENTS

| | | | | |
|---|---|---|---|---|
| EP | 1705288 | A2 * | 9/2006 | D21H 19/80 |
| EP | 1705288 | A2 | 9/2006 | |
| EP | 2441869 | A1 * | 4/2012 | D04H 1/4258 |
| EP | 2599914 | A1 * | 6/2013 | B41M 5/41 |
| EP | 2599914 | A1 | 6/2013 | |
| EP | 3540121 | A1 * | 9/2019 | D21H 27/004 |
| JP | H04-370300 | | 12/1992 | |
| JP | H 08-133385 | | 1/1996 | |
| JP | H 09-49188 | | 2/1997 | |
| JP | H09-49188 | | 2/1997 | |
| JP | H09-121939 | | 5/1997 | |
| JP | 09-170193 | A | 6/1997 | |
| JP | 09-254112 | A | 9/1997 | |
| JP | 2001-115368 | A | 4/2001 | |
| JP | 2001/175279 | | 6/2001 | |
| JP | 2001/279696 | | 10/2001 | |
| JP | 2004-314623 | | 11/2004 | |
| JP | 2004/314623 | | 11/2004 | |
| JP | 2006-299498 | | 11/2006 | |
| JP | 2012-061612 | A | 3/2012 | |
| JP | 2012061612 | A * | 3/2012 | |
| JP | 2012-214937 | | 11/2012 | |
| JP | 2016-3419 | | 1/2016 | |
| WO | WO-2009126226 | A1 * | 10/2009 | B05D 3/0272 |
| WO | WO-2010143736 | A1 * | 12/2010 | D04H 1/492 |
| WO | WO 2012/014970 | | 2/2012 | |
| WO | WO-2012014970 | A1 * | 2/2012 | B41M 5/41 |
| WO | WO 2018/221016 | A1 | 12/2018 | |

OTHER PUBLICATIONS

International Search Report corresponding to International Application No. PCT/JP2017/038133 dated Dec. 26, 2017.
Notification of Transmittal of Translation of the International Report on Patentability corresponding to International Application No. PCT/JP2017/038133 dated May 23, 2019.
Written Opinion of the International Searching Authority corresponding to International Application No. PCT/JP2018/014912 dated Jul. 10, 2018.
International Search Report corresponding to International Application No. PCT/JP2018/014912 dated Jul. 10, 2018.
International Preliminary Report on Patentability corresponding to International Application No. PCT/JP2018/014912 dated Dec. 3, 2019.
Written Opinion of the International Searching Authority corresponding to International application No. PCT/JP2017/038133 dated Dec. 26, 2017.

* cited by examiner

WATER-DISPERSIBLE SHEET

FIELD OF THE INVENTION

The present invention relates to a water-dispersible sheet comprising a tacky adhesive layer on one side and a coating layer, such as a thermosensitive recording layer and an inkjet recording layer, on the other side.

BACKGROUND OF THE INVENTION

Water-dispersible paper (also referred to as Water-disintegrable paper or Water-soluble paper) which is rapidly dispersed in water is widely used for applications such as filter-wrapping paper of cigarettes, confidential document paper, water-dispersible label. See e.g., Japanese Patent Application Public Disclosure H09-49188. Among these, the water-dispersible label has a structure in which a coating layer such as a thermosensitive recording layer or an inkjet recording layer is installed on a surface of the water-dispersible paper so that printing can be performed on the surface and a water-soluble tacky adhesive layer is installed on the back surface. And these are used by adhering these to returnable containers etc. See e.g., Japanese Patent Application Public Disclosure 2004-314623.

In addition, water-dispersible papers with a multilayer structure have been developed in order to add various capabilities for various applications while maintaining the water dispersibility. See e.g., Japanese Patent Application Public Disclosure 2006-299498 and Japanese Patent Application Public Disclosure H04-370300. For example, a water-dispersible paper has a multilayer structure comprising alkalized fibrous carboxymethyl cellulose and papermaking water-dispersible fibers in order to improve the printing/print suitability thereof, when applying a pigment coating layer or a thermosensitive recording layer on water-dispersible paper see Japanese Patent Application Public Disclosure 2006-299498), or a water-dispersible paper has a multilayer structure with a reduced amount of paper adhesive (for example, fibrous carboxyalkyl cellulose salt) in the layer in contact with the dryer in order to smoothly perform the papermaking. See Japanese Patent Application Public Disclosure H04-370300.

Problems to be Solved by the Invention

However, the base paper of the conventional water-dispersible label on which the tacky adhesive layer is installed was designed only from the view point of performance in water dispersibility and suitability as a coating base paper. See e.g., Japanese Patent Application Public Disclosure H09-49188 and Japanese Patent Application Public Disclosure 2004-314623. Therefore, there was a problem that the tacky adhesiveness of the water-dispersible label degrades with time (see Comparative Example 1).

Therefore, the objective of the present invention is to provide a water-dispersible sheet with a suppressed time degradation of the tacky adhesiveness of the tacky adhesive layer, while maintaining the water dispersibility.

Means to Solve the Problems

As a result of intensive study of the above problems, the inventors have found that the time degradation of the tacky adhesiveness of the tacky adhesive layer can be suppressed, while maintaining the water dispersibility, by using a base paper of the water-dispersible sheet with a multilayer structure, wherein one of the multilayer (inner layer) which is not in contact with a tacky adhesive layer and the other layer (surface layer) which is in contact with the tacky adhesive layer are independently mixtures of papermaking fibers and an alkalized fibrous carboxymethyl cellulose, wherein the ratio of these and the beating degree are set in the specific ranges.

That is, the present invention provides a water-dispersible sheet comprising a paper substrate comprising an inner layer and at least one surface layer, wherein

- the inner layer comprises papermaking fibers with a Canadian standard freeness of from 600 to 750 ml CSF and an alkalized fibrous carboxymethyl cellulose,
- the surface layer comprises papermaking fibers and an alkalized fibrous carboxymethyl cellulose,
- a tacky adhesive layer is installed on one of the surface layer (hereinafter referred to as "first surface layer"),
- the Canadian standard freeness of the papermaking fibers in the first surface layer is 400 to 575 ml CSF, and
- the content of the papermaking fibers in the first surface layer is 60 to 90 weight %.

Also this invention provides a paper substrate for use in a water-dispersible sheet, comprising an inner layer and two surface layers installed on both sides of the inner layer, wherein

- the inner layer comprises papermaking fibers with a Canadian standard freeness of from 600 to 750 ml CSF and an alkalized fibrous carboxymethyl cellulose,
- each of the surface layers independently comprises papermaking fibers and an alkalized fibrous carboxymethyl cellulose,
- the Canadian standard freeness of at least one of the surface layers is 400 to 575 ml CSF, and
- the content of the papermaking fibers in the at least one of the two surface layers is 60 to 90 weight %.

Also this invention further provides a method for producing a water-dispersible label comprising the steps of, (1) providing a paper substrate for use in a water-dispersible sheet, comprising (i) an inner layer and (ii) a first surface layer and a second surface layer installed on both sides of the inner layer, wherein

- the inner layer comprises papermaking fibers with a Canadian standard freeness of from 600 to 750 ml CSF and an alkalized fibrous carboxymethyl cellulose,
- the first surface layer and the second surface layer independently comprise papermaking fibers and an alkalized fibrous carboxymethyl cellulose,
- the Canadian standard freeness of at least one of the surface layers is 400 to 575 ml CSF,
- the content of the papermaking fibers in the at least one of the surface layers is 60 to 90 weight %, and (2) installing a tacky adhesive layer on the first surface layer.

DETAILED DESCRIPTION OF THE INVENTION

Figure 1:
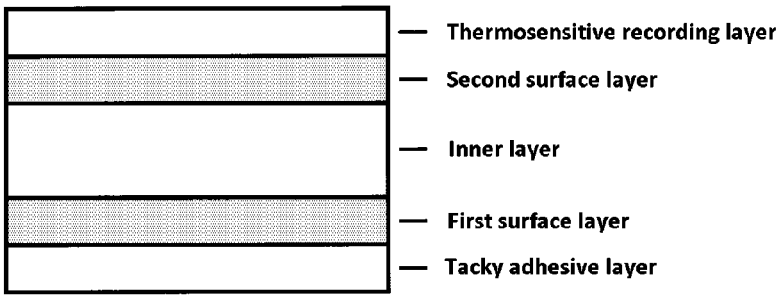
FIG. 1 shows the configuration of the water-dispersible sheet of the present invention. Among these, the inner layer, the first surface layer and the tacky adhesive layer are essential elements of the water-dispersible sheet of the present invention, but the second surface layer and the thermosensitive recording layer are optional elements of the water-dispersible sheet of the present invention.

The water-dispersible sheet of the present invention comprises a paper substrate (hereinafter also referred to as "base paper") and a tacky adhesive layer, and this base paper comprises an inner layer and at least one surface layer. The water-dispersible label has a tacky adhesive layer on one surface layer of this base paper (hereinafter also referred to as "first surface layer"). This water-dispersible label may have a second surface layer on the other side of the inner layer, that is, opposite to the first surface layer. The configuration of the water-dispersible sheet of the present invention is shown in FIG. 1.

Either of the inner layer and the surface layer, both of which constitute the base paper of the present invention, comprises papermaking fibers and fibrous carboxymethyl cellulose.

The papermaking fibers includes wood pulp fiber or non-wood type pulp fiber generally used for papermaking, for example, wood pulp fiber such as softwood kraft pulp, hardwood kraft pulp, dissolving pulp, mercerized pulp, and non-wood pulp fibers such as flax pulp, Manila hemp pulp and kenaf pulp, purified cellulose fibers such as lyocell, and the like. The average fiber length of the water-dispersible fiber for papermaking is 0.1 to 5 mm, preferably 0.5 to 3 mm, more preferably 0.8 to 2 mm.

The fibrous carboxymethyl cellulose is obtained by carboxyalkylation of natural cellulose fiber, regenerated cellulose fiber, purified cellulose fiber by a known method, and is water insoluble. The examples thereof include fibrous carboxymethyl cellulose, fibrous carboxyethyl cellulose and the like. The substitution degree of the carboxyalkyl group of the fibrous carboxyalkyl cellulose is preferably 0.2 to 1.0, more preferably 0.4 to 0.6.

In the present invention, the fibrous carboxymethyl cellulose is alkalized with an alkalizing agent. By alkalizing the base paper, the water-insoluble fibrous carboxyalkyl cellulose in the base paper is converted to a water-soluble fibrous carboxyalkyl cellulose salt by a neutralization reaction, and the fibers are liable to swell or disintegrate in water, then the base paper becomes water dispersible.

The alkalizing agent is an aqueous solution of an alkaline compound. Specific examples of the alkalizing agent include alkali metal hydroxides such as sodium hydroxide and potassium hydroxide, alkali metal carbonates or hydrogencarbonate such as sodium carbonate and sodium hydrogencarbonate, alkali metal phosphates such as sodium hydrogen phosphate, hydrogen phosphate, organic acid salts of alkali metals such as sodium acetate, hydroxides of alkaline earth metals such as calcium hydroxide, ammonia and ammonium salts, amines such as ethanolamine, and aqueous solutions of polyethylene imine with a molecular weight of 1,000 or less, etc.

This alkalization may be carried out by mixing the stock solution with the alkalizing agent when paper-making the base paper, or, after the paper making, by spraying the alkalizing agent by using a sprayer, coating the alkalizing agent by using a coating machine, or transferring the alkalizing agent to the stock by using a felt or the like attaching with the alkalizing agent. Alternatively, it can be carried out by any other suitable method.

This alkalization may also be carried out by including the alkalizing agent in the first surface layer or the second surface layer before installing the tacky adhesive layer on the base paper, or by including the alkalizing agent in the second surface layer after installing the tacky adhesive layer on the base paper. When the alkalization is carried out when paper-making the base paper as described above, the tacky adhesive layer may be installed on the first surface layer of the base paper.

In the case where the coating layer described below is installed on the second surface layer, the alkalizing agent may be included in the second surface layer before installing the coating layer, or the alkalizing agent may be included in the first surface layer after installing the coating layer, if the tacky adhesive layer is installed on the base paper. When the alkalization is carried out when paper-making the base paper as described above, the coating layer may be installed on the second surface layer.

In the case of coating the alkalizing agent on a base paper by using a coating machine, the alkalizing agent may be applied as an aqueous solution of the alkaline compound or a mixed solution of the alkaline compound and an aqueous organic solvent compatible with the aqueous solution by using a coating machine, such as a known air knife coater, bar coater, roll coater, blade coater, curtain coater, champerex coater, gravure coater or the like.

The viscosity of the solution of the alkaline compound nay be adjusted suitable for the coating machine to be used, and the aqueous solution of the alkaline compound may be mixed with water soluble polymer compatible with the aqueous solution in order to prevent the alkaline compounds from falling off after drying. Examples of the water-soluble polymer include starch and starch derivatives, cellulose derivatives such as carboxyalkyl cellulose salt, alginate, polyacrylate and the like.

The coating amount of the alkaline compound is preferably equal to or greater than the equivalent to neutralize the fibrous carboxymethyl cellulose in the base paper, more preferably 1 to 3 times the neutralization equivalent. If the amount of the alkaline compound is less than the neutralization equivalent, water insoluble fibrous carboxyalkyl cellulose remains, then it becomes difficult to obtain sufficient water dispersibility, and the solubility is greatly reduced since the carboxyalkyl celluloses are bonded with each other over time. In addition, if the amount of the alkaline compound exceeds 3 times the neutralization equivalent, it is not preferable because changes in the appearance and material occurs such as discoloration, strength reduction, etc. of the base paper due to the influence of the alkaline compound remaining in the base paper.

The content of the alkaline compound in the base paper varies depending on the basic weight of the base paper, the degree of substitution and the content of the fibrous carboxyalkyl cellulose, the type of the alkaline compound to be used, and the like, and is desirably appropriately adjusted. By way of example, when the alkaline compound is sodium carbonate, the content of the alkaline compound is 0.3 to 67% by weight based on the weight of the base paper, and when the alkaline compound is sodium hydroxide, the content is 2 to 51% by weight.

The water-dispersible sheet (particularly the base paper thereof) may be immersed in or coated by a water soluble polymer in order to improve the water dispersibility and the dry strength of the water-dispersible sheet. For example, a water-soluble polymer may be added to the aqueous solution of the alkaline compound when alkalizing the base paper.

Thereby, the inter-fiber space of the base paper are filled with the water-soluble polymer, then the dry strength of the water-dispersible sheet is increased, and also the water-soluble polymer existing in the inter-fiber space is swollen by contacting with water to widen the fibers apart, then the fibers become to be easily separated.

As the water-soluble polymer, those of which the dried coating film is easy to re-dissolve in water are preferable. The water-soluble polymer includes, for example, starch and starch derivatives; cellulose derivatives such as carboxyalkyl cellulose salts, hydroxyalkyl cellulose and alkyl cellulose; natural polymers such as alginate and xanthan gum; polyacrylate; polyvinyl alcohol and modified polyvinyl alcohol such as carboxy-modified polyvinyl alcohol; polyvinyl pyrrolidone; gelatin; casein and the like. These may be used solely or in combination of two or more. Among these, it is preferable to use a carboxymethyl cellulose salt from the viewpoint of improving water dispersibility and strength.

The inner layer constituting the base paper of the present invention comprises papermaking fibers and an alkalized fibrous carboxymethyl cellulose, and the content of the papermaking fibers in the inner layer is preferably 20 to 80 weight %, more preferably 40 t 70% by weight. The Canadian standard freeness of the papermaking fibers used in the inner layer is 600 to 750 ml CSF, preferably 630 to 720 ml CSF. The Canadian Standard Freeness is that measured in accordance with Japanese Industrial Standard (JIS) P8121-2 2012 (the same applies hereinafter).

As the beating proceeds (the freeness decreases), fibrillation, cutting and internal swelling of the fiber proceed, then the density, strength and smoothness of the base paper increase, while the water dispersibility decreases.

The surface layer (including the first surface layer and the second surface layer) comprises papermaking fibers and an alkalized fibrous carboxymethyl cellulose.

The Canadian standard freeness of the papermaking fibers in the surface layer (the first surface layer) on which the tacky adhesive layer is installed is 400 to 575 ml CSF, preferably 425 to 525 ml CSF, and the content of papermaking fibers in the surface layer is 60 to 90 weight %, preferably 65 to 80 weight %.

On the other hand, the Canadian standard freeness of the papermaking fibers and the content of the papermaking fibers in the surface layer (the second surface layer) on which the tacky adhesive layer is not installed are appropriately set according to the intended use of it. These compositions of the second surface layer may be, for example, the same as the composition of the first surface layer or the same as the composition of the inner surface layer.

In the present invention, since the base paper has such multilayer structure (two layers or three layers) and the surface layer (first surface layer) on which the tacky adhesive layer is installed has the above-described composition, the time degradation of the tacky adhesiveness of the tacky adhesive layer can be suppressed, while maintaining the water dispersibility.

The basic weight of the base paper of the present invention is usually 10 to 200 g/m$^2$, and in particular, it is suitably 50 g/m$^2$ or more in general, preferably 50 to 120 g/m$^2$ as the base paper of coated paper for printing.

The basic weight of each layer is usually in the range of 5 to 100 g/m$^2$, preferably 10 to 100 g/m$^2$.

In the water-dispersible sheet of the present invention, a tacky adhesive layer is installed on one of the surface layer (first surface layer).

As the tacky adhesive composing the tacky adhesive layer, a tacky adhesive having water-solubility or water re-dispersibility, particularly a water-soluble acrylic tacky adhesive is suitably used.

Examples of the water-soluble acrylic tacky adhesive include those containing, as a base polymer, those comprise a copolymer comprising alkoxyalkyl acrylate and styrene sulfonate and other copolymerizable monomer, or a copolymer of a carboxyl group-containing vinyl monomer such as (meth) acrylic acid and a hydroxyl group-containing monomer and optionally other copolymerizable monomer, and the like. Examples of the water re-dispersible acrylic tacky adhesive include those containing, as a base polymer, those comprise a copolymer of an alkyl (meth) acrylate ester, a carboxyl group-containing vinyl monomer, a vinyl monomer having an alkoxy group, and optionally other copolymerizable monomer, or a copolymer obtained by copolymerization of carboxylated rosin ester-containing vinyl monomer, carboxyl group-containing vinyl monomer and water soluble vinyl monomer, and the like. The carboxyl group of these copolymers may be in the form of a salt in which a part or the whole thereof is neutralized with an alkali as necessary, in which alkali metal salts, amine salts and alkanolamine salts are preferable as the alkali.

A crosslinking agent may be added to the water-soluble acrylic tacky adhesive in order to adjust the adhesion strength, water solubility or water dispersibility. Such crosslinking agent is not particularly limited, but arbitrary ones can be appropriately selected from those conventionally used as crosslinking agents in acrylic tacky adhesives. Examples the crosslinking agent include, for example, isocyanate crosslinking agent such as 1,2-ethylene diisocyanate, epoxy type crosslinking agent such as diglycidyl ether, melamine resins, urea resins, dialdehydes, methylol polymers, metal chelate compounds, metal alkoxides, metal salts and the like. A conventionally known plasticizer, tackifier, colorant, thickener, defoaming agent, leveling agent, plasticizer, antifungal agent, antioxidant and the like may be added to the acrylic tacky adhesive in order to adjust the properties as necessary and to improve the performance. The plasticizer and the tackifier are preferably water-soluble or water-dispersible. Examples of the plasticizer include polyhydric alcohols such as sugar alcohols, polyether polyols, alkanolamine salts of oxidized rosin, and the like. And examples of the tackifier include alkali metal salts such as rosin, disproportionated rosin and hydrogenated rosin, ammonium salts, polyether esters and the like.

These tacky adhesives may be (i) directly applied on the alkalizing agent-coated surface of the base paper, or (ii) applied on the release agent containing surface of the release sheet to form a tacky adhesive layer, which is then adhered to the alkalizing agent coated surface of the base paper to transfer the adhesive layer to the alkalizing agent coated surface of the base paper. In either case, a release sheet may be pasted on the adhesive layer and peeled off at the time of use as desired, in order to prevent unnecessary adhesion at times other than use. The coating amount (solid content) of the tacky adhesive layer formed on the base paper is about 3 to 60 g/m$^2$, preferably about 10 to 50 g/m$^2$. When the tacky adhesive coating amount is less than 5 g/m$^2$, the formed tacky adhesive sheet is insufficient in tacky adhesiveness. On the other hand, when the tacky adhesive coating amount exceeds 60 g/m$^2$, the tacky adhesive easily protrudes during production of the tacky adhesive sheet or in a post-processing step, which is not preferable.

The release sheet is not particularly limited and conventionally known release sheet may be used, for example, paper base materials such as glassine paper, coated paper, cast coated paper; laminated paper obtained by laminating thermoplastic resins such as polyethylene etc. on these base paper materials; or various plastic films such as polyethylene terephthalate, polypropylene, polyethylene and the like, on whose one side or both sides release agent such as silicone resin are applied. The basic weight of the release sheet is not particularly limited, but it is usually about 20 to 120 g/m$^2$.

The application of the tacky adhesive may be carried out by a printing method and the tacky adhesive may be applied in a pattern shape excluding an edge portion and the like. And the release sheet used in this case may also be partially coated with a release agent corresponding to the pattern shape of the tacky adhesive. Furthermore, a releasing agent is partially coated on the surface of the water dispersible sheet of the present invention on the side without the alkalizing agent applied, in a dotted or rectangular noncontiguous pattern, while the adhesive is partially coated on the surface of the alkalizing agent coated side in a pattern corresponding to the releasing agent, then the partially adhesive coated surface and the release agent partially coated surface are superimposed to form a tacky adhesive sheet which does not require a release sheet.

Arbitrary coating layers such as thermosensitive recording layer or inkjet recording layer may be installed on the other side (i.e. second surface layer) of the water-dispersible sheet of the present invention, opposite to the tacky adhesive layer, depending on the application.

The coating layer in the present invention may be a single layer or a multilayer as long as it is formed by coating and drying aqueous coating materials, and the coating method is not limited. In addition, the components of the coating layer may be appropriately chosen from those suitable for the coating or printing method (offset printing, gravure printing, inkjet printer, thermal printer, laser beam printer, etc.).

Examples of the coating layers suitable for thermal printers, inkjet printers, and gravure printing are shown below.

(I) Example of Coating Layer (Thermosensitive Recording Layer) Suitable for Thermal Printers:

In order to adapt the water dispersible sheet of the present invention to printing with a thermal printer, a thermosensitive recording layer containing, as main components, a colorless or pale electron donating leuco dye (henceforth referred to as "leuco dye") and an electron accepting color developing agent (henceforth referred to as "color development agent") is installed on the second surface of the base paper. An undercoat coating layer comprising a pigment and a binder as main components may be installed between the base paper and the thermosensitive recording layer. Since the base paper has a porous layer (with high heat insulating effect) containing fibrous carboxyalkyl cellulose, the debris forming and the sticking properties are improved.

The smoothness of the surface of the base paper on which the undercoat layer is installed is not particularly limited, but in general, a highly smooth surface is preferred, and a Yankee dryer contacted surface and a calendaring treated surface are suitably used.

The undercoat layer is installed to enhance the smoothness of the surface of the base paper and achieve sharpness and high sensitivity of the image in the thermosensitive recording medium. Any known pigments, binders and various additives are properly selected to be used for the undercoat layer. It is preferable to install the undercoat layer, because, without the undercoat layer, the thermosensitive recording layer contacts directly with the base paper containing the alkalizing agent then the coloring sensitivity of the thermosensitive recording layer may be lowered.

As the pigment for the undercoat layer, inorganic pigments such as silica, calcium carbonate, clay, kaolin, calcined kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, sodium aluminosilicate and magnesium aluminosilicate and the like, or organic pigments such as melamine resin pigment, urea-formalin resin pigment, polyethylene powder, nylon powder and the like may be mentioned.

As the binder of the undercoat layer, water-soluble resins and water-dispersible resins are preferable, the example include starches, hydroxyethyl cellulose, methylcellulose, carboxymethyl cellulose salt, gelatin, casein, sodium alginate, polyvinyl alcohol, modified polyvinyl alcohol, polyvinyl pyrrolidone, polyacrylamide, acrylamide/acrylate copolymer, styrene/maleic anhydride copolymer and alkali salt thereof, ethylene/maleic anhydride copolymer and alkali salt thereof, sodium polyacrylate and the like. Among them, from the viewpoint of water dispersibility, it is desirable to use water-soluble resins such as starch, hydroxyethyl cellulose, methyl cellulose, carboxymethyl cellulose salt, gelatin, casein, sodium alginate, polyvinyl alcohol, modified polyvinyl alcohol, polyvinyl pyrrolidone as the main component of the binder.

The amount (solid content) of the binder in the undercoat layer is usually 5 to 100 parts by weight per 100 parts by weight of the pigment.

In addition to the pigment and the binder, commonly used various additives may be used for the undercoat layer. Examples of the various additives include pigment dispersants, defoaming agents, lubricants, UV absorbers, sizing agents, sensitizers, fluorescent dyes, preservatives, and the like.

The undercoat layer may be obtained by applying the coating material obtained by dispersing and mixing the pigment and the binder with other additives in one layer or multi-layers by using a coating machine then drying by heating it by using a dryer or the like. The coating amount (solid content) of the undercoat layer is usually 0.5 to 50 g/m$^2$, preferably 3 to 15 g/m$^2$. Examples of the coating machine include air knife coater, bar coater, roll coater, blade coater, curtain coater, champlex coater, gravure coater etc.

As the leuco dyes used for the thermosensitive recording layer of the present invention, any known leuco dyes can be used solely or in combination of two or more, and in particular, leuco compounds of dye such as triphenylmethane type, fluoran type, phenothiazine type, auramine type, spiropyran type, indolinophthalide type and the like are preferably used. Examples of the leuco dyes include 3,3-bis(p-Dimethyl aminophenyl)-phthalide, 3,3-bis(p-Dimethyl aminophenyl)-6-dimethylaminophthalide [alternate name: crystal violet lactone], 3,3-bis(p-Dimethyl aminophenyl)-6-diethylaminophthalide, 3,3-bis(p-Dimethyl aminophenyl)-6-chlorophthalide, 3,3-bis(p-Dibuthyl aminophenyl)-phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzfluorane, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-{N-(3'-trifluoromethylphenyl) amino}-6-diethylaminofluoran, 2-{3,6-bis (diethylamino)-9-(o-chloroanilino) xanthylbenzoic acid lactam}, 3-diethylamino-6-methyl-7-(m-trichloromethylanilino) fluoran, 3-diethylamino-7-(o-chloroanilino) fluoran, 3-di-n-butylamino-7-(o-chloroanilino) fluoran, 3-N-methyl-N, n-amylamino-6-methyl-7-anilinofluoran, 3-N-methyl-N-cyclohexylamino-6-methyl-7-anilinofluoran, 3-diethylamino-6-methyl-7-anilinofluoran, 3-(N, N-diethylamino)-5-methyl-7-(N, N-dibenzylamino) fluoran, Benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorophenyl) phthalide, 3-(2'-hydroxy-4'-dimethylaminophenyl)-3-(2'-methoxy-5'-nitrophenyl) phthalide, 3-(2'-hydroxy-4'-diethylaminophenyl)-3-(2'-methoxy-5'-methylphenyl) phthalide, 3-(2'-methoxy-4'-dimethylaminophenyl)-3-(2'-hydroxy-4'-chloro-5'-methylphenyl) phthalide, 3-(N-ethyl-N-tetrahydrofurfuryl) amino-6-methyl-7-anilinofluoran, 3-N-ethyl-N-(2-ethoxypropyl) amino-6-methyl-7-anilinofluoran, 3-N-methyl-N-isobutyl-6-methyl-7-anilinofluoran, 3-morpholino-7-(N-propyl-trifluoromethylanilino) fluoran, 3-pyrrolidino-7-m-trifluoromethylanilinofluoran, 3-diethylamino-5-chloro-7-(N-benzyl-trifluoromethylanilino) fluoran, 3-pyrrolidino-7-(di-p-chlorophenyl) methylaminofluoran, 3-diethylamino-5-chloro-7-(α-phenylethylamino) fluoran, 3-(N-ethyl-p-toluidino)-7-(α-phenylethylamino) fluoran, 3-diethylamino-7-(o-methoxycarbonylphenylamino) fluoran, 3-diethylamino-5-methyl-7-(α-phenylethylamino) fluoran, 3-diethylamino-7-piperidinofluoran, 2-chloro-3-(N-methyltoluidino)-7-(p-n-butylanilino) fluoran, 3-(N-methyl-N-isopropylamino)-6-methyl-7-anilinofluoran, 3-di-n-butylamino-6-methyl-7-anilinofluoran, 3,6-bis (dimethylamino) fluorene spiro (9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-diethylamino-6-methyl-7-mesityzino-4',5'-benzofluoran, 3-N-methyl-N-isopropyl-6-methyl-7-anilinofluoran, 3-N-ethyl-N-isoamyl-6-methyl-7-anilinofluoran, 3-Diethylamino-6-methyl-7-(2',4'-dimethylanilino) fluoran, and the like.

The water dispersible sheet of the present invention are possibly used in an application to be washed away to a drainage groove after use, therefore, among these, preferably used are leuco dyes with higher safety from the viewpoint of environment, such as 3-diethylamino-6-methyl-7-anilinofluoran, 3-dibutylamino-6-methyl-7-anilinofluoran, 3-(N-cyclohexyl-N-methylamino)-6-methyl-7-anilinofluoran, 3-(N-ethyl-N-isopentylamino)-6-methyl-7-anilinofluoran, 3-N-di-n-pentylamino-6-methyl-7-anilinofluoran, 3-diethylamino-7-(3-trifluoromethylanilino) fluoran, 3-(N-ethyl-N-4-methylphenylamino)-6-methyl-7-anilinofluoran, 3-diethylamino-6-methyl-7-(3-methylanilino) fluoran, 3,3'-bis (dimethylaminophenyl)-6-dimethylaminophthalide, 3-(4-diethylamino-2-ethoxyphenyl)-3-(1-ethyl-2-methylindol-3-yl)-4-azaphthalide, 2-(N-phenyl-N-methylamino)-6-(N-p-tolyl-N-ethylamino) fluoran, 3,3-bis (1-n-butyl-2-methyl-indol-3-yl) phthalide, 1,3-dimethyl-6-diethylaminofluoran, 3-Bromo-3-methyl-6-dibutylaminofluoran, and the like.

As the color developing agent contained in the thermosensitive recording layer together with the leuco dye, phenols, organic acids or inorganic acids or their esters, salts and the like may be used. Example of the color developing agent include gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isopropylidenediphenol, 1,1'-isopropylidenebis (2-chlorophenol), 4,4'-isopropylin bis (2,6-dibromophenol), 4,4'-isopropylidenebis (2,6-dichlorophenol), 4,4'-isopropylidenebis (2-methylphenol), 4,4'-isopropylidenebis (2,6-dimethylphenol), 4,4-isopropylidenebis (2-tert-butylphenol), 4,4'-sec-butylidenediphenol, 4,4'-cyclohexylidene bisphenol, 4,4'-cyclohexylidene bis (2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolac type phenolic resin, 2,2'-thiobis (4,6-dichlorophenol), catechol, resorcin, hydroquinone, pyrogallol, fluoroglycine, fluoroglycine carboxylic acid, 4-tert-octyl catechol, 2,2'-methylenebis (4-chlorophenol), 2,2'-methylenebis (4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-hydroxybenzoic acid-p-chlorobenzyl, p-hydroxybenzoic acid-o-chlorobenzyl, p-hydroxybenzoic acid-p-methylbenzyl, p-hydroxybenzoic acid-n-octyl, benzoic acid, zinc salicylate, 1-hydroxy-2-naphthoic acid, 2-hydroxy-6-naphthoic acid, zinc 2-hydroxy-6-naphthoate, 4-hydroxydiphenyl sulfone, 4-hydroxy-4'-chlorodiphenyl sulfone, bis (4-hydroxyphenyl) sulfide, 2-hydroxy-p-toluic acid, zinc 3,5-di-tert-butylsalicylate, 3,5-di-tert-butyl salicylate, tartaric acid, oxalic acid, maleic acid, citric acid, succinic acid, stearic acid, 4-hydroxyphthalic acid, boric acid, thiourea derivatives, 4-hydroxythiophenol derivatives, bis (4-hydroxyphenyl) acetic acid, ethyl bis (4-hydroxyphenyl) acetate, N-propyl bis (4-hydroxyphenyl) acetate, N-butyl bis (4-hydroxyphenyl) acetate, phenyl bis (4-hydroxyphenyl) acetate, bis (4-hydroxyphenyl) acetate benzyl, phenethyl bis (4-hydroxyphenyl) acetate, bis (3-methyl-4-hydroxyphenyl) acetic acid, methyl bis (3-methyl-4-hydroxyphenyl) acetate, N-propyl bis (3-methyl-4-hydroxyphenyl) acetate, 1,7-bis (4-hydroxyphenylthio) 3,5-dioxaheptane, 1,5-bis (4-hydroxyphenylthio) 3-oxapentane, dimethyl 4-hydroxyphthalate, 4-hydroxy-4'-methoxydiphenyl sulfone, 4-hydroxy-4'-ethoxydiphenyl sulfone, 4-hydroxy-4'-isopropoxy diphenyl sulfone, 4-hydroxy-4'-propoxy diphenyl sulfone, 4-hydroxy-4'-butoxydiphenyl sulfone, 4-hydroxy-4'-isobutoxydiphenyl sulfone, 4-hydroxy-4'-sec-butoxydiphenyl sulfone, 4-hydroxy-4'-tert-butoxydiphenyl sulfone, 4-hydroxy-4'-benzyloxy diphenyl sulfone, 4-hydroxy-4'-phenoxydiphenyl sulfone, 4-hydroxy-4'-(m-methylbenzyloxy) diphenyl sulfone, 4-hydroxy-4'-(p-methylbenzyloxy) diphenyl sulfone, 4-hydroxy-4'-(o-methylbenzyloxy) diphenyl sulfone, 4-hydroxy-4'-(p-chlorobenzyloxy) diphenylsulfone and the like.

The water dispersible sheet of the present invention are possibly used in an application to be washed away to a drainage groove after use, therefore, among these, preferably used are color developing agents with higher safety from the viewpoint of environment, such as 4,4'-dihydroxydiphenyl sulfone, 2,4'-dihydroxydiphenyl sulfone, 4-hydroxy-4'-isopropoxy diphenyl sulfone, benzyl parahydroxybenzoate, 4-hydroxy-4'-propoxy diphenyl sulfone, 3-{[(phenylamino) carbonyl]amino}benzenesulfonamide, N-(4'-hydroxyphenylthio) acetyl-2-hydroxyaniline, 1:1 mixture of N-(4'-hydroxyphenylthio) acetyl-4-hydroxyaniline and N-(4'-hydroxyphenylthio) acetyl-2-hydroxyaniline, 4,4'-bis (3-(phenoxycarbonylamino) methylphenylureido) diphenyl sulfone, composition of color developing agents containing 2,2'-bis[4-(4-hydroxyphenylsulfone) phenoxy] diphenyl ether, and the like.

Any known binders can be used for the thermosensitive recording layer. Examples of the main ingredient of the binder include polyvinyl alcohols such as fully saponified polyvinyl alcohol and partially saponified polyvinyl alcohol; modified polyvinyl alcohols such as carboxy-modified polyvinyl alcohol, amide-modified polyvinyl alcohol, sulfonic acid-modified polyvinyl alcohol, butyral-modified polyvinyl alcohol, and other modified polyvinyl alcohol; water-soluble resin such as hydroxyethyl cellulose, methyl cellulose, carboxymethyl cellulose salt, starches, gelatin, casein, sodium alginate, polyvinyl pyrrolidone, polyacrylamide, acrylamide/acrylate copolymer, alkali salt of styrene/maleic anhydride copolymer, alkali salt of ethylene/maleic anhydride copolymer; water dispersible resins such as styrene-butadiene copolymer, acrylonitrile/butadiene copolymer, methyl acrylate/butadiene copolymer, acrylonitrile/butadiene/styrene terpolymer, cellulose derivatives such as ethyl cellulose, acetyl cellulose, polyvinyl chloride, polyvinyl acetate, vinyl acetate/acrylic acid ester copolymer, ethylene/vinyl acetate copolymer, polyacrylic esters, styrene/acrylate copolymer, polyurethane resin, polyvinyl butyral polystyrene and copolymers thereof, polyamide resin, silicone resin, petroleum resin, terpene resin, ketone resin, coumarone resin. These may be used by being dissolved into a solvent such as water, alcohol, ketone, ester, hydrocarbon, etc. These also may be used in a state of being emulsified or paste dispersed in water or other medium, and these may also be used in combination depending on the required quality. Among these, water-soluble resins are preferably used as the main ingredient of the binder from the viewpoint of water dispersibility, such as starches, hydroxyethyl cellulose, methyl cellulose, carboxymethyl cellulose salt, gelatin, casein, sodium alginate, polyvinyl alcohols, modified polyvinyl alcohols, and polyvinylpyrrolidone.

In the thermosensitive recording layer, auxiliary additives may be used together with the leuco dye, the color developing agent and the binder, if necessary. Examples of the auxiliary additives include sensitizers, pigments, stabilizers such as p-nitrobenzoic acid metal salt (Ca, Zn) or phthalic acid monobenzyl ester metal salt (Ca, Zn), releasing agents such as fatty acid metal salt, lubricants such as waxes, pressure coloring preventing agents, benzophenone and triazole UV absorbers, waterproofing agents such as glyoxal, dispersing agents, antifoaming agents, etc.

Thermoplastic materials are used as a sensitizer to improve the thermal responsiveness, and a thermoplastic organic compound with a melting point of about 50 to 200 degree C. may be used. Examples of such thermoplastic organic compound include stearic acid amide, palmitic acid amide, N-hydroxymethylstearic acid amide, N-stearyl stearic acid amide, ethylene bis stearic acid amide, N-stearyl urea, benzyl-2-naphthyl ether, m-terphenyl, 4-benzylbiphenyl, 2,2'-bis (4-methoxyphenoxy) diethyl ether, a, α'-diphenoxyxylene, bis (4-methoxyphenyl) ether, diphenyl adipate, dibenzyl oxalate, di (4-chlorobenzyl) oxalate, dimethyl terephthalate, dibenzyl terephthalate, benzenesulfonic acid phenyl ester, bis (4-allyloxyphenyl) sulfone, 4-acetylacetophenone, acetoacetic acid anilides, fatty acid anilides, montan wax, polyethylene wax, benzyl p-benzyloxybenzoate, di-p-tolyl carbonate, phenyl-α-naphthyl carbonate, 1,4-diethoxynaphthalene, 1-hydroxy-2-naphthoic acid phenyl ester, 1,2-bis-(3-methylphenoxy) ethane, di (p-methylbenzyl) oxalate, 1,2-bis (phenoxymethyl) benzene, diphenyl sulfone, para phenyl acetophenone, β-benzyloxynaphthalene, 4-biphenyl-p-tolyl ether, o-xylerine-bis-(phenyl ether), 4-(m-methylphenoxymethyl) biphenyl and the like.

The water dispersible sheet of the present invention are possibly used in an application to be washed away to a drainage groove after use, therefore, among these, preferably used are sensitizers with higher safety from the viewpoint of environment, such as stearic acid amide, palmitic acid amide, ethylene bis stearic acid amide, benzyl p-benzyloxybenzoate, 4-biphenyl-p-tolyl ether, di (p-methylbenzyl) oxalate, di (4-chlorobenzyl) oxalate, 4-benzylbiphenyl, 1,2-bis (phenoxymethyl) benzene, diphenyl sulfone, β-benzyloxynaphthalene, paraphenylacetophenone, 1,2-bis-(3-methylphenoxy) ethane, and the like.

Examples of the pigments include inorganic filler, such as silica, calcium carbonate, clay, kaolin, calcined kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, sodium aluminosilicate, magnesium aluminosilicate and the like; or organic pigments, such as melamine resin pigment, urea-formalin resin pigment, polyethylene powder, nylon powder and the like.

The types and amounts of the leuco dye, color developing agent, sensitizer and other various ingredients are determined according to the required performance and printability and are not particularly restricted. However, from 0.5 parts to 10 parts of the color developing agent and from 0.5 parts to 10 parts of the sensitizer are ordinarily used per 1 part of the leuco dye, and the amount of the binder is suitably 5 to 50% by weight in the total solid content.

The leuco dye, the color developing agent and the materials added when needed are finely ground into particles, several microns or smaller in size, using a grinder or a suitable emulsification device such as a ball mill, attritor, sand grinder and the like, and a coating solution is prepared by adding a binder and various additive materials depending on the objective.

The method for forming the thermosensitive recording layer is not limited in particular, and the layer is formed by, for example, coating and drying the coating material on the base paper by a method such as various printing methods such as planographic printing, or air knife coating, rod blade coating, bar coating, blade coating, gravure coating, curtain coating and the like. The coating amount of the thermosensitive recording layer is usually in the range of from 2 to 12 $g/m^2$, preferably from 3 to 10 $g/m^2$.

Also, the matching property with the thermal head or the like and the storage image storage property can be improved by optionally installing a protective layer on the thermosensitive recording layer.

As the binder used for the protective layer, the same type as the binder used for thermosensitive recording layer may be used. Examples of the main ingredient of the binder include polyvinyl alcohols such as fully saponified polyvinyl alcohol and partially saponified polyvinyl alcohol; modified polyvinyl alcohols such as carboxy-modified polyvinyl alcohol, amide-modified polyvinyl alcohol, sulfonic acid-modified polyvinyl alcohol, butyral-modified polyvinyl alcohol, and other modified polyvinyl alcohol; water-soluble resin such as hydroxyethyl cellulose, methyl cellulose, carboxymethyl cellulose salt, starches, gelatin, casein, sodium alginate, polyvinyl pyrrolidone, polyacrylamide, acrylamide/acrylate copolymer, alkali salt of styrene/maleic anhydride copolymer, alkali salt of ethylene/maleic anhydride copolymer; water dispersible resins such as styrene-butadiene copolymer, acrylonitrile/butadiene copolymer, methyl acrylate/butadiene copolymer, acrylonitrile/butadiene/styrene terpolymer, cellulose derivatives such as ethyl cellulose, acetyl cellulose, polyvinyl chloride, polyvinyl acetate, vinyl acetate/acrylic acid ester copolymer, ethylene/vinyl acetate copolymer, polyacrylic esters, styrene/acrylate copolymer, polyurethane resin, polyvinyl butyral polystyrene and copolymers thereof, polyamide resin, silicone resin, petroleum resin, terpene resin, ketone resin, coumarone resin.

These may be used by being dissolved into a solvent such as water, alcohol, ketone, ester, hydrocarbon, etc. These also may be used in a state of being emulsified or paste dispersed in water or other medium, and these may also be used in combination depending on the required quality. Among these, water-soluble resins are preferably used as the main ingredient of the binder from the viewpoint of water dispersibility, such as starches, hydroxyethyl cellulose, methyl cellulose, carboxymethyl cellulose salt, gelatin, casein, sodium alginate, polyvinyl alcohols, modified polyvinyl alcohols, and polyvinylpyrrolidone.

Examples of the additives used for the protective layer include pigments, surfactants, lubricants, pressure coloring inhibitors, and the like. The specific examples of the pigment and the lubricant are the same as those exemplified in the thermosensitive recording layer. The protective layer is obtained by preparing the coating material by dispersing and mixing various additives in the binder, applying the coating material in one or more layers by a coating machine and drying it by heating with a dryer.

The coating amount (solid content) of the protective layer is usually 0.2 to 10 g/m$^2$, preferably 0.5 to 5 g/m$^2$. The coating machine is not particularly limited, and known coating machines can be used such as air knife coater, bar coater, roll coater, blade coater, curtain coater, champlex coater, gravure coater and the like.

In the present invention, it is preferable to increase the surface smoothness of the thermosensitive recording layer side of the water dispersible sheet in order to improve the image sharpness and sensitivity by using a smoothing device such as calendar, super calendar, soft nip calendar or the like.

The Bekk smoothness on the surface of the thermosensitive recording layer side is preferably 50 to 2000 seconds, more preferably 100 to 2000 seconds. If the Bekk smoothness is less than 50 seconds, the effect of improving the image sharpness and sensitivity may be poor. Also, if the Bekk smoothness exceeds 2000 seconds, a decrease in water dispersibility may become apparent due to the increase in the density of the base paper, which is not preferable.

(II) Example of Coating Layer Suitable for Inkjet Printers (Inkjet Recording Layer):

In order to adapt the water-dispersible sheet of the present invention to printing with an inkjet printer, it is preferable to install, on the second surface layer of the base paper, a pigment coating layer comprising a pigment and an aqueous binder as main components or a clear coat layer comprising a cationic resin and/or an aqueous binder as main components. The pigment, binder and various additives may be selected appropriately from any known pigments, binders and various additives and used, and the compounding amounts of these may be appropriately adjusted according to the required quality. In addition, since the base paper contains a porous layer (having high ink absorbability) comprising fibrous carboxyalkyl cellulose, it has an improved ink absorbability.

Examples of the pigments include inorganic pigments such as silica, colloidal silica, calcium carbonate, clay, kaolin, calcined kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, sodium aluminosilicate, magnesium aluminosilicate, calcium carbonate complex silica; or organic pigments such as melamine resin pigment, urea-formalin resin pigment, polyethylene powder, nylon powder, styrene, styrene-acryl, acryl. Among these, silica, alumina, calcined kaolin, calcium carbonate or the like are preferably used from the viewpoints of ink absorbability and coloring property.

As the binder, water-soluble resins and water-dispersible resins are preferred, such as starch, hydroxyethyl cellulose, methyl cellulose, carboxymethyl cellulose salt, gelatin, casein, sodium alginate, polyvinyl alcohol, modified polyvinyl alcohol, polyvinyl pyrrolidone, polyacrylamide, acrylamide/acrylate copolymer, styrene/maleic anhydride copolymer and its alkali salt, ethylene/maleic anhydride copolymer and its alkali salt, styrene/butadiene copolymer, sodium polyacrylate, vinyl acetate, ethylene-vinyl acetate, acrylic acid copolymer, methacrylic acid copolymer, acrylic acid/methacrylic acid copolymer and the like. Among these, polyvinyl alcohol, modified polyvinyl alcohol, or the like are preferably used from the viewpoints of ink absorbability and coloring property.

Examples of the additives include cationic resins (dye fixing agents), pigment dispersants, defoaming agents, lubricants, UV absorbers, sizing agents, fluorescent dyes, preservatives, and the like. Among these, cationic resin is preferably used in combination because it significantly improves the water resistance and color development of the image area.

The coating machine is not particularly limited, and air knife coater, bar coater, roll coater, blade coater, curtain coater, cast coater, champlex coater, gravure coater, two rolls coater, transfer roll coater, and the like may be used.

(III) Example of Coating Layer Suitable for Gravure Printing:

In order to adapt the water-dispersible sheet of the present invention to gravure printing, it is preferable to install, on the second surface layer of the base paper, a pigment coating layer comprising a pigment and an aqueous binder as main components or a clear coat layer comprising an aqueous binder as main components. The pigment, binder and various additives may be selected appropriately from any known pigments, binders and various additives and used. In addition, since the base paper contains a porous layer (having high cushioning property) comprising fibrous carboxyalkyl cellulose, it has an improved ink adherence.

Examples of the pigments include inorganic pigment such as calcium carbonate, clay, kaolin, calcined kaolin, diatomaceous earth, talc, titanium oxide, aluminum hydroxide, magnesium carbonate, zinc oxide, aluminum oxide, magnesium hydroxide, barium sulfate, calcium sulfate, zinc sulfate, calcium silicate, aluminum silicate, magnesium silicate, sodium aluminosilicate, magnesium aluminosilicate, silica, colloidal silica, calcium carbonate composite silica and the like; or organic pigment such as melamine resin pigment, urea-formalin resin pigment, polyethylene powder, nylon powder, styrene, styrene-acryl, acryl and the like.

As the binder, water-soluble resins and water-dispersible resins are preferred, such as starch, hydroxyethyl cellulose, methyl cellulose, carboxymethyl cellulose salt, gelatin, casein, sodium alginate, polyvinyl alcohol, modified polyvinyl alcohol, polyvinyl pyrrolidone, polyacrylamide, acrylamide/acrylate copolymer, styrene/maleic anhydride copolymer and its alkali salt, ethylene/maleic anhydride copolymer and its alkali salt, styrene/butadiene copolymer, sodium polyacrylate, vinyl acetate, ethylene-vinyl acetate, acrylic acid copolymer, methacrylic acid copolymer, acrylic acid/methacrylic acid copolymer and the like. Among these, from the viewpoint of water dispersibility, preferred binders are water-soluble resins such as starch, hydroxyethyl cellulose, methyl cellulose, carboxymethyl cellulose salt, gelatin, casein, sodium alginate, polyvinyl alcohol, modified polyvinyl alcohol, polyvinyl pyrrolidone.

Examples of the additives include cationic resins (dye fixing agents), pigment dispersants, defoaming agents, lubricants, UV absorbers, sizing agents, fluorescent dyes, preservatives, and the like.

The coating machine is not particularly limited, and air knife coater, bar coater, roll coater, blade coater, curtain coater, cast coater, champlex coater, gravure coater, two rolls coater, transfer roll coater, and the like may be used.

The water-dispersible sheet of the present invention thus obtained can, after it is adhered to a substrate such as a container or a returnable container, be easily removed from the substrate only by being rinsed off with water.

EXAMPLES

The following Examples illustrate the present invention, but the Examples are not intended to limit the scope of the present invention.

Example 1

(Preparation of Base Paper)

A hand-made paper with a three-layer structure was prepared by laminating an inner layer and two surface layers with piling up these layers together so that each single layer of surface layer is formed on each side of the inner layer in a weight ratio of a surface layer:an inner layer:a surface layer=1:2:1. The inner layer comprises a papermaking raw material comprising 33 parts by weight of fibrous carboxymethyl cellulose (CMC-CB manufactured by Nichirin Chemical Industries, Ltd., etherification degree 0.43, hereinafter referred to as "CMC") and 67 parts by weight of mixed pulp consisting of 15% by weight of softwood bleached kraft pulp and 85% by weight of hardwood bleached kraft pulp, which was combinely beaten up to Canadian standard freeness of 670 mL CSF. The surface layers comprise a papermaking raw material comprising 33 parts by weight of fibrous carboxymethyl cellulose (the same as above) and 67 parts by weight of mixed pulp (composition is the same as above), which was combinely beaten up to Canadian standard freeness of 500 mL CSF. A base paper was prepared by applying 2.5 weight % aqueous solution of sodium carbonate (soda ash light, manufactured by Tokuyama Corporation) on the obtained hand-made paper (with impregnation of 10% to the hand-made paper) by a size press method.

(Installation of Thermosensitive Recording Layer)

First color development agent dispersion (solution A), a dye dispersion (solution B) and a sensitizer dispersion (solution C) with the following formulation were separately wet ground using sand grinders until the average particle size was about 1.0 μm.

Color Development Agent Dispersion (Solution A)

| | |
|---|---|
| 4-Hydroxy-4'-isopropoxy diphenyl sulfone (Nippon Soda Co., Ltd., D8) | 6.0 parts |
| Aqueous solution of completely saponified polyvinyl alcohol (Kuraray Co., Ltd. PVA117, solid content: 10%) | 18.8 parts |
| Water | 11.2 parts |

Leuco Dye Dispersion (Solution B)

| | |
|---|---|
| 3-Dibutylamino-6-methyl-7-anilinofluorane (Yamamoto Chemicals Inc. 0DB-2) | 2.0 parts |
| Aqueous solution of completely saponified polyvinyl alcohol (Kuraray Co., Ltd. PVA117, solid content: 10%) | 4.6 parts |
| Water | 2.6 parts |

Sensitizer Dispersion (Solution C)

| | |
|---|---|
| 4-biphenyl-p-tolyl ether (Nicca Chemical Co., Ltd.) | 4.0 parts |
| Aqueous solution of completely saponified polyvinyl alcohol (Kuraray Co., Ltd. PVA117) | 5.0 parts |
| Water | 3.0 parts |

Next these dispersions were blended in the proportion described below to prepare the thermosensitive recording layer coating solution.

Thermosensitive recording layer coating solution

| | |
|---|---|
| Color development agent dispersion (Solution A) | 36.0 parts |
| Leuco dye dispersion (Solution B) | 9.2 parts |
| Sensitizer dispersion (Solution C) | 12.0 parts |

This thermosensitive recording layer coating solution was applied on a surface (second surface layer) of the base paper with a coating amount (in solid) of 6.0 g/m$^2$ and was dried (at 50 degree C.) to form a thermosensitive recording layer to obtain a recording paper. Then the recording paper was subjected to a smoothing treatment so that its Bekk smoothness was 500 to 1000 seconds.

(Installation of Tacky Adhesive Layer)

A tacky adhesive coating solution with the following formulation was prepared.

Tacky Adhesive Coating Material

| | |
|---|---|
| Water-soluble acrylic adhesive (Soken Chemical & Engineering Co., Ltd., SK Dyne 1170, solid content 40 wt %) | 100 parts by weight |
| Neutralizer (methanol solution of potassium hydroxide, Soken Chemical & Engineering Co., Ltd., Tenkazai K-10 M, solid content 10 wt %) | 6.7 parts by weight |
| Epoxy resin type curing agent (Soken Chemical & Engineering Co., Ltd., Kokazai E-14, solid content 10 wt %) | 0.9 parts by weight |

This tacky adhesive coating material was coated on the release treated surface of a commercially available release sheet, which is coated with a silicone release agent, with an amount (in solid) of 25 g/m$^2$ then was dried to form a tacky adhesive layer. This tacky adhesive layer was then adhered to the other side (first surface layer) of the recording paper, opposite to the thermosensitive recording layer to prepare a water dispersible sheet.

Example 2

A water dispersible sheet was prepared in the same manner as in Example 1 with the exception of beating the mixed pulp formulated for the surface layers up to Canadian standard freeness of 450 mL CSF.

Example 3

A water dispersible sheet was prepared in the same manner as in Example 1 with the exception of beating the mixed pulp formulated for the surface layers up to Canadian standard freeness of 400 mL CSF.

Example 4

A water dispersible sheet was prepared in the same manner as in Example 1 with the exception of beating the mixed pulp formulated for the surface layers up to Canadian standard freeness of 550 mL CSF.

Comparative Example 4

A water dispersible sheet was prepared in the same manner as in Example 1 with the exception of beating the mixed pulp formulated for the surface layers up to Canadian standard freeness of 600 mL CSF.

Example 5

A water dispersible sheet was prepared in the same manner as in Example 1 with the exception of beating the mixed pulp formulated for the second surface layer up to Canadian standard freeness of 400 mL CSF.

Example 6

A water dispersible sheet was prepared in the same manner as in Example 1 with the exception of changing the three-layer structure of the hand-made paper to a two-layer structure in which the weight ratio of a surface layer:an inner layer is 1:3, the second surface layer was not installed, and the thermosensitive recording layer was installed on the inner layer.

Example 7

A water dispersible sheet was prepared in the same manner as in Example 1 with the exception of not installing the thermosensitive recording layer.

Example 8

A water dispersible sheet was prepared in the same manner as in Example 1 with the exception that an aqueous solution containing 2.5 weight % of sodium carbonate and 1.0 weight % of carboxymethyl cellulose sodium salt (trade name: Sunrose, manufactured by Nippon Paper Industries Co., Ltd., viscosity of 5 mPa-s as 2% by weight aqueous solution at 20 degree C.) as a water-soluble polymer was applied on the hand-made paper by a size press method instead of applying 2.5 weight % aqueous solution of sodium carbonate on the hand-made paper.

Comparative Example 1

A water dispersible sheet was prepared in the same manner as in Example 1 except that a single layer sheet was prepared by the inner layer with the formulated papermaking raw material and a thermosensitive recording layer and a tacky adhesive layer were formed directly on both sides of the inner layer.

Comparative Example 2

A water dispersible sheet was prepared in the same manner as in Example 1 except that the fibrous carboxymethyl cellulose (etherification degree 0.43) was not contained in the surface layer, then the surface layer consisted only of the mixed pulp.

Comparative Example 3

A water dispersible sheet was prepared in the same manner as in Example 1 except that the surface layer consisted only of the fibrous carboxymethyl cellulose, then the mixed pulp was not contained in the surface layer.

The prepared water-dispersible sheets were evaluated at 14 days after applying tacky adhesive then being stored at room temperature (23 degree C., 50% RH). When evaluating the water dispersibility, the release paper was removed before the evaluation.

1) Water Dispersibility

Five test pieces of 3 cm square were prepared from each of the water-dispersible sheet. Then, one piece of the above test piece was put into a 300 ml beaker with deionized water while stirring at 650 rpm with a stirrer. The time required for the test piece to break into two or more and become flocked was determined with a stopwatch. Then the average value of five measurements was taken as the water dispersion time. The shorter the water dispersion time, the better the water dispersibility.

2) Tacky Adhesion Over Time

According to Japanese Industrial Standard (JIS) Z0237, three test pieces of 25 mm×250 mm were cut out from each of the water-dispersible sheet, and the tacky adhesive surface of the test piece with the release paper peeled off was put on a stainless steel plate (100×150 mm), then a rubber roller weighing 3 kg was reciprocated twice on the test piece.

The stainless steel plate was clamped by the lower chuck of a tensile tester, while one end of the tacky adhesive test piece was folded 180° and clamped by the upper chuck of the tensile tester. Then a 180 degree peel test was conducted at a tensile speed of 300 mm/min to measure the tacky adhesion (g/25 mm).

3) Print Image Quality

The thermosensitive recording surface of the prepared water-dispersible sheet was recorded a gradational pattern by using a recording tester for thermosensitive recording paper (Okura Engineering Co. LTD., TH-PMD, equipped with a thermal printer head manufactured by Kyocera) at a recording energy of from 0.150 mJ/dot to 0.345 mJ/dot in increments of 0.015 mJ/dot. Then the recorded area was evaluated by visual observation according to the following criteria. The better the image quality, the better the surface (second surface layer) of the water-dispersible sheet.

Good: No unevenness was observed in the print image

Fair: Some unevenness was observed in the print image, but is within the allowable range Poor: Much unprinted area was observed in the print image The configuration of the water-dispersible sheet and the evaluation results are shown in Table 1. And the tacky adhesion of the tacky adhesive layer versus the Canadian standard freeness of the pulp contained in the first surface layer is shown in FIG. 2.

TABLE 1

| | tacky adhesive layer | First surface layer Pulp Freeness | First surface layer Pulp Content | First surface layer CMC Content | Inner layer Pulp Freeness | Inner layer Pulp Content | Inner layer CMC Content | Second surface layer Pulp Freeness | Second surface layer Pulp Content | Second surface layer CMC Content | water-soluble polymer | thermo-sensitive recording layer | evaluation result: Water dispersion time (sec) | evaluation result: Tacky adhesion (g/25 mm) | evaluation result: Print image quality |
|---|---|---|---|---|---|---|---|---|---|---|---|---|---|---|---|
| Example 1 | | 500 | 67% | 33% | 670 | 67% | 33% | 500 | 67% | 33% | — | installed | 13.8 | 769 | Good |
| Example 2 | installed | 450 | 67% | 33% | 670 | 67% | 33% | 450 | 67% | 33% | — | installed | 16.6 | 732 | Good |
| Example 3 | installed | 400 | 67% | 33% | 670 | 67% | 33% | 400 | 67% | 33% | — | installed | 20.6 | 583 | Good |
| Example 4 | installed | 550 | 67% | 33% | 670 | 67% | 33% | 550 | 67% | 33% | — | installed | 13.7 | 599 | Good |
| Example 5 | installed | 500 | 67% | 33% | 670 | 67% | 33% | 400 | 67% | 33% | — | installed | 15.7 | 606 | Good |
| Example 6 | installed | 500 | 67% | 33% | 670 | 67% | 33% | | — | | — | installed | 10.8 | 609 | Fair |
| Example 7 | installed | 500 | 67% | 33% | 670 | 67% | 33% | 500 | 67% | 33% | — | — | 5.4 | 721 | — |
| Example 8 | installed | 500 | 67% | 33% | 670 | 67% | 33% | 500 | 67% | 33% | applied | installed | 12.6 | 787 | Good |
| Comparative Example 1 | installed | | — | | 670 | 67% | 33% | | — | | — | installed | 9.7 | 478 | Fair |
| Comparative Example 2 | installed | 500 | 100% | 0% | 670 | 67% | 33% | 500 | 100% | 0% | — | installed | 20.9 | 332 | Good |
| Comparative Example 3 | installed | 500 | 0% | 100% | 670 | 67% | 33% | 500 | 0% | 100% | — | installed | 5.4 | 261 | Poor |
| Comparative Example 4 | installed | 600 | 67% | 33% | 670 | 67% | 33% | 600 | 67% | 33% | — | installed | 12.0 | 487 | Good |

Figure 2:
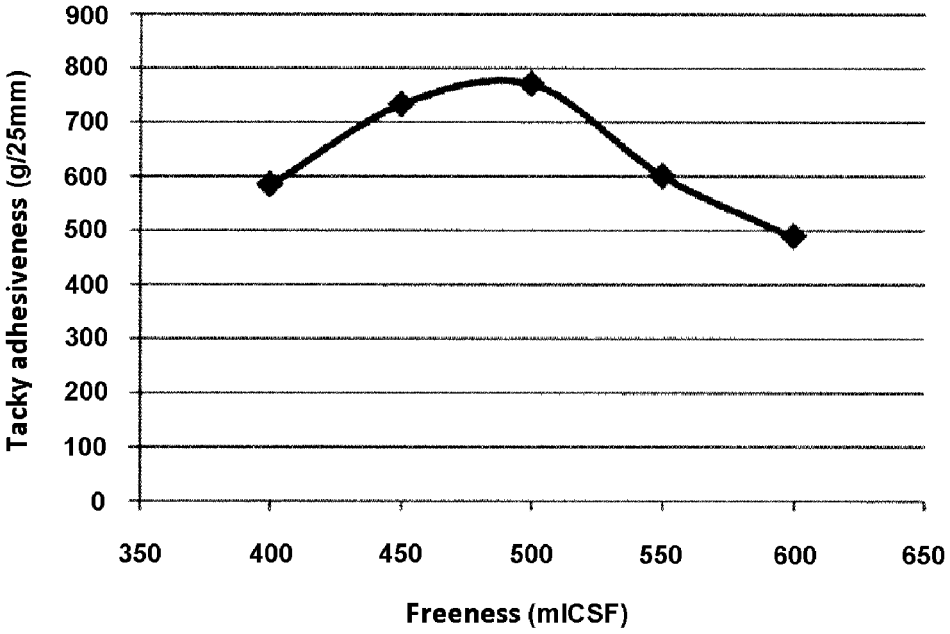
FIG. 2 is a figure of the data of Examples 1 to 4 and Comparative Example 4 (Table 1), showing the tacky adhesiveness of the tacky adhesive layer versus Canadian standard freeness of the pulp contained in the first surface layer (a layer having a tacky adhesive layer thereon). The vertical axis shows the tacky adhesive strength (g/25 mm) 14 days after preparation, and the horizontal axis shows Canadian standard freeness of the pulp contained in the first surface layer.

It is understood from Table 1 and FIG. 2 that the water-dispersible sheet of the present invention has a suppressed time degradation of the tacky adhesiveness of the tacky adhesive layer, while maintaining the water dispersibility.

What is claimed is:

1. A water-dispersible sheet comprising a paper substrate comprising an inner layer and two surface layers, a first surface layer and a second surface layer, wherein a tacky adhesive layer is installed on the first surface layer, wherein the inner layer comprises papermaking fibers with a Canadian standard freeness of from 600 to 750 ml CSF and an alkalized fibrous carboxymethyl cellulose, the first surface layer comprises papermaking fibers and an alkalized fibrous carboxymethyl cellulose, the Canadian standard freeness of the papermaking fibers in the first surface layer is 425 to 525 ml CSF, and the content of the papermaking fibers in the first surface layer is 60 to 90 weight %, and wherein the second surface layer, on a side of the inner layer opposite to the first surface layer, comprises papermaking fibers with a Canadian standard freeness of from 400 to 575 ml CSF and an alkalized fibrous carboxymethyl cellulose.

2. The water-dispersible sheet of claim 1, wherein the content of the papermaking fibers in the inner layer is 20 to 80 weight %.

3. The water-dispersible sheet of claim 1, wherein the content of the papermaking fibers in the second surface layer is 60 to 90 weight %.

4. The water-dispersible sheet of claim 1, comprising a thermosensitive recording layer on the second surface layer.

5. The water-dispersible sheet of claim 1, wherein an aqueous coating material is applied on the second surface layer.

6. The water-dispersible sheet of claim 1, wherein the composition of the first surface layer and the composition of the second surface layer are the same.

7. A paper substrate for use in a water-dispersible sheet, comprising an inner layer and two surface layers, a first surface layer and a second surface layer, installed on opposite sides of the inner layer, wherein the inner layer comprises papermaking fibers with a Canadian standard freeness of from 600 to 750 ml CSF and an alkalized fibrous carboxymethyl cellulose, each of the two surface layers independently comprises papermaking fibers and an alkalized fibrous carboxymethyl cellulose, the Canadian standard freeness of the first surface layer is 425 to 525 ml CSF, the Canadian standard freeness of the second surface layer is 400 to 575 ml CSF, and the content of the papermaking fibers in the first surface layer is 60 to 90 weight %.

8. The paper substrate of claim 7, wherein the content of the papermaking fibers in the inner layer is 20 to 80 weight %.

9. The paper substrate of claim 7, comprising a thermosensitive recording layer on at least one of the two surface layers.

10. The paper substrate of claim 7, wherein the compositions of the two surface layers are the same.

11. A method for producing a water-dispersible sheet comprising the steps of:

1) providing a paper substrate for use in a water-dispersible sheet, comprising i) an inner layer and ii) a first surface layer and a second surface layer installed on opposite sides of the inner layer, wherein the inner layer comprises papermaking fibers with a Canadian standard freeness of from 600 to 750 ml CSF and an alkalized fibrous carboxymethyl cellulose, the first surface layer and the second surface layer independently comprise papermaking fibers and an alkalized fibrous carboxymethyl cellulose, the Canadian standard freeness of the first surface layer is 425 to 525 ml CSF, the Canadian standard freeness of the second surface layer is 400 to 575 ml CSF, and the content of the papermaking fibers in the first surface layer is 60 to 90 weight %, and 2) installing a tacky adhesive layer on the first surface layer.

12. The method of claim 11, wherein the content of the papermaking fibers in the inner layer is 20 to 80 weight %.

13. The method of claim 11, further comprising the step of 3) applying an aqueous coating material on the second surface layer, between the steps of 1) and 2).

14. The method of claim 11, further comprising the step of 3) installing a thermosensitive recording layer on the second surface layer, between the steps of 1) and 2).

15. The method of claim 11, wherein the composition of the first surface layer and the composition of the second surface layer are the same.

* * * * *